US005890479A

United States Patent [19]

Morin

[11] Patent Number: 5,890,479

[45] Date of Patent: Apr. 6, 1999

[54] TRIGGER ASSIST SYSTEM

[76] Inventor: Ernest Arthur Morin, 33 Rosemont St., Haverhill, Mass. 01830

[21] Appl. No.: 144,147

[22] Filed: Aug. 31, 1998

[51] Int. Cl.[6] ..... F41B 11/00

[52] U.S. Cl. ..... 124/31; 124/32; 124/73; 124/77

[58] Field of Search ..... 124/31, 32, 37, 124/38, 73, 74, 75; 42/41, 42.01; 89/139

[56] References Cited

U.S. PATENT DOCUMENTS

| | | | |
|---|---|---|---|
| 3,650,174 | 3/1972 | Nelsen | 89/28 |
| 3,854,231 | 12/1974 | Broyles | 42/84 |
| 4,602,608 | 7/1986 | Lacam et al. | 124/74 |
| 4,936,282 | 6/1990 | Dobbins | 124/74 |
| 5,349,938 | 9/1994 | Farrell | 124/73 |
| 5,462,042 | 10/1995 | Greenwell | 124/76 |
| 5,503,137 | 4/1996 | Fusco | 124/72 |
| 5,613,483 | 3/1997 | Lukas et al. | 124/73 |
| 5,669,369 | 9/1997 | Scott | 124/73 |
| 5,704,342 | 1/1998 | Gibson et al. | 124/73 |
| 5,711,286 | 1/1998 | Petrosyan et al. | 124/73 |

FOREIGN PATENT DOCUMENTS

| | | |
|---|---|---|
| 0440428 A2 | 8/1991 | European Pat. Off. . |
| 0440428 A3 | 8/1991 | European Pat. Off. . |
| 0440428 B1 | 8/1991 | European Pat. Off. . |
| 0467089 A2 | 1/1992 | European Pat. Off. . |
| 0467089 A3 | 1/1992 | European Pat. Off. . |

*Primary Examiner*—J. Woodrow Eldred
*Attorney, Agent, or Firm*—Thomas M.. Johnson

[57] ABSTRACT

A trigger assist system. The system utilizes a means to detect cycle progress of a pneumatic gun and communicates to a means to forcibly return the trigger to a released position. The trigger is forcibly released against the user's applied finger pressure allowing the gun to complete a cycle and come to position whereby the gun is ready to be fired, or cycled, again. The trigger assist system then relaxes the trigger allowing the user's applied pressure to again pull the trigger. In one embodiment, the means to detect cycle progress is a switchable pneumatic valve in communication with the bolt of the gun. In another embodiment, the means to detect cycle progress is an electronic circuit in communication with the trigger system. In one embodiment, the means to forcibly return the trigger to a released position is a pneumatic piston. In another embodiment, the means to forcibly return the trigger to a released position is an electronic solenoid. In another embodiment, there is also a means to control cycle speed. In one embodiment, the means to control cycle speed is an adjustable flow controller in communication with the bolt.

14 Claims, 5 Drawing Sheets

TRIGGER ASSIST SYSTEM

FIELD OF THE INVENTION

The present invention relates generally to firearms of the semi-automatic type. More specifically, the present invention relates to a trigger assist system on semiautomatic pneumatic guns, but may also be employed on other semi-automatic firearms.

BACKGROUND OF THE INVENTION

Semi-automatic pneumatic guns are well know in the firearm arts. A well known type of pneumatic gun is the paintball gun. The paintball gun is a pneumatic gun that propels gelatinous balls filled with a marking paint, called paintballs. Paintball guns are generally used for recreational purposes including mock battles where the idea is to shoot the opposing team members. The paintballs break when they strike an opponent and mark the opponent with the paint. Another common use for paintball guns is the marking of cattle by ranchers for identification.

There are two basic types of pneumatic paintball guns: open bolt and closed bolt. The bolt is the part of a gun that moves the ammunition into the barrel of the gun, in this case the ammunition being a paintball. In the open bolt system, the bolt is normally in the rearward position. When the trigger is pulled, the bolt moves forward pushing a paintball into the barrel of the gun. A blast of propellant then pushes the paintball out of the gun. The propellant is usually $CO_2$, compressed air or nitrogen. The bolt is then returned to the rearward, or open, position awaiting the next pull of the trigger.

In the closed bolt system, the bolt is normally in the forward position with the paintball already in the barrel. When the trigger is pulled, a blast of propellant pushes the path. When the bolt reaches the fall rearward position, it slides forward and pushes the paintball into the barrel. It remains in the forward position with the paintball in the barrel until the trigger is pulled again.

A non-semiautomatic firearm, also known as pump action or bolt action, would require the user to manually move the bolt after each pull of the trigger. A semi-automatic firearm is one in which a full cycle of the bolt is accomplished by each pull of the trigger; a full cycle being both firing and reloading of the ammunition. A fully automatic firearm is one in which the bolt will continue to fully cycle until the trigger is released. Pneumatic guns, such as paintball guns, are also available as automatic, semi-automatic or non-semiautomatic versions.

Pneumatic guns, especially paintball guns, have been the subject of many patents. Most of the prior art relates either to conversion of non-semiautomatic guns to semi-automatic guns or to improvement in the bolt action and propellant delivery systems. U.S. Pat. No. 5,503,137 to Fusco demonstrates a method of converting a non-semiautomatic paintball gun to a semi-automatic gun. U.S. Pat. No. 4,936,282 to Dobbins et al. demonstrates a "gas powered gun" that can either be non-semiautomatic or semiautomatic within the same gun.

One of the limiting factors of semi-automatic firearms and pneumatic guns is the users ability to continually pull the trigger in a rapid manner when higher rates of fire are desired. Human finger speed can be quick for only a short period of time and would not be continually uniform. The use of a fully automatic gun is often cost prohibitive and fully automatic guns are sometimes not allowed in paintball tournaments. Fully automatic guns also have complicated internal mechanisms which make them more prone to jamming and breaking and makes them harder to fix. The prior art has not addressed these issues. Therefore, it can be appreciated that there is room in the art for significant improvement on the prior art with regard to the trigger action. The present invention addresses these needs.

SUMMARY OF THE INVENTION

The present invention provides for a means to forcibly push the trigger to a released position so the user can keep a constant pressure on the trigger and not have to release the trigger manually. This arrangement allows the gun to fire as quickly as the bolt can cycle, but does not render the gun fully automatic because the trigger is pulled for each firing of the gun.

The present invention consists of three basic components: a means to detect cycle progress, a means to force the trigger to a released position, and means to control cycle speed. A means to detect cycle progress could be accomplished by sensing the bolt position. The bolt position, both in an open bolt and closed bolt system, will tell where in the cycle the gun is; firing, reloading, or somewhere in between. The bolt position could be detected using a switchable pneumatic valve, an electronic switch and solenoid, a magnetic sensor, an infrared switch or any other means well known in the art to detect position in communication with the bolt. The cycle progress could also be determined by timing the cycle from the moment the trigger is pulled using a timing circuit connected to the trigger or one of the air lines on the gun. The cycle progress needs to be sensed to determine when the trigger will be forcibly released and when the trigger can be pulled again. In an open bolt gun, the trigger will be forcibly released when the bolt has reached a point proximate the full forward travel and can be pulled again when the bolt reaches the fully open position. In a closed bolt gun, the trigger will be forcibly released when the bolt has reached a point proximate the fall rearward travel and can be pulled again when the bolt reaches the fully closed position.

The means to detect cycle progress will communicate with the means to force the trigger to the released position. The means to force the trigger to the released position could be a pneumatic piston, such as a single acting spring return piston or a double acting piston, or an electronic solenoid, either double acting or spring return. The trigger is forcibly released against the user'applied pressure and then relaxed allowing the user'applied pressure to again pull the trigger and cycle the gun. The present invention allows automatic-like firing without rendering the gun automatic. The present invention is advantageous in this respect because automatic guns are both expensive and often prohibited from paintball competitions. The present invention is also advantageous because of its simplicity. Automatic guns often have complicated internal workings which are susceptible to jamming or breaking. The present invention is added to semi-automatic guns without changing any of the internal workings present and can be disabled during play, if desired, simply by turning off the means to force the trigger to its released position.

The means to control cycle speed is employed to adjust the rate of the cycle. The present invention will allow a cycle rate, or fire rate, with which present ammunition feeders cannot keep pace. The means to control cycle speed of the present invention, as it relates to paintball guns, will easily allow fine tuning to adjust the cycle rate to allow paintballs to drop in front of the bolt without being chopped and broken by the bolt. This can be accomplished on a closed bolt system by slowing the motion of the bolt to allow the paintball to fully drop into the bolt path before being pushed into the barrel. The means to control cycle speed could be a flow controller on a closed bolt system. A flow controller could be employed to directly slow the motion of the bolt. A flow controller allows for a wide range of fire rate and almost infinite incrementation within that range. In an open bolt system, the trigger assist system itself would have to be slowed because the bolt in an open bolt system cannot be slowed. The trigger assist system itself can be slowed by using a delay circuit, either electrical or pneumatic, which will not allow the means to force the trigger to its released position to deactivate as quickly. When faster ammunition delivery systems are invented, the present invention will allow for easy increase in the fire rate. There is also an added advantage over prior art paintball guns in that adjustments to the fire rate can be made in the field during play to conserve ammunition or increase fire rate.

While the present invention details employment on a paintball gun, one skilled in the art will appreciate that the present invention can be used on other pneumatic guns, such as semi-automatic BB guns, or any pneumatic system that employs a trigger as the user interface, such as a nail gun. One skilled in the art would also appreciate the application of the present invention to semi-automatic firearms because of similar bolt travel and cycling. In applying the present invention to semi-automatic firearms, the flow controller would not be necessary because the bolt will cycle only as fast as ammunition can be loaded by a clip.

BRIEF DESCRIPTION OF DRAWINGS

These and other features of the invention can be understood with reference to the specification and the drawings, in which.

DETAILED DESCRIPTION OF THE PREFERRED EMBODIMENTS

Figure 1:
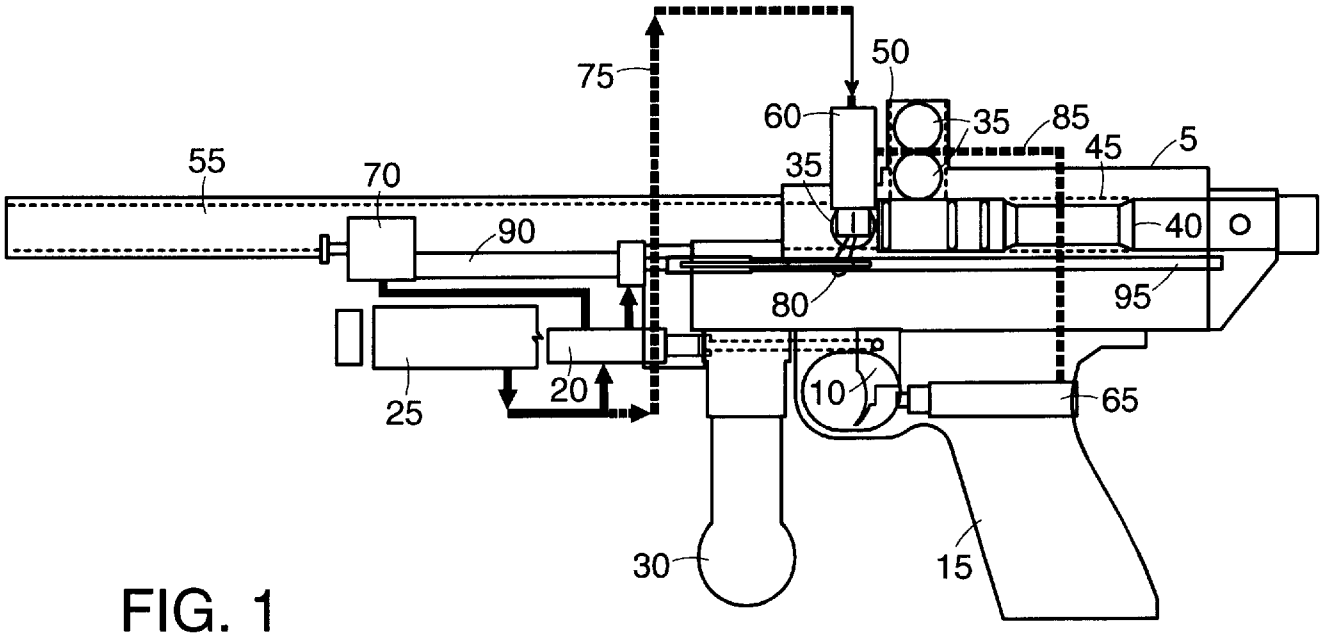
FIG. 1 is a side view, including the internal workings, of a pneumatic gun at a ready stage equipped with an embodiment of the invention.

In brief overview, FIG. 1 represents an embodiment of a pneumatic gun 5 equipped with an embodiment of the invention at a ready stage. That is, the pneumatic gun 5 is ready to be fired. A person skilled in the art will understand that a pneumatic gun 5 utilizes a trigger 10 located within or in front of a handle 15. The trigger 10 is in communication with a control valve 20. The control valve 20 is in fluid communication with a regulator 25 which regulates a system propellant 30. The system propellant 30 is used to forcibly eject a projectile 35 and supply the regulator 25 and the control valve 20 to move a bolt 40 within a receiver 45. The bolt 40 seals the receiver 45 and a projectile loader 50 in communication with the receiver 45 to allow more force to be applied from the system propellant 30 to the projectile 35 to move it down a barrel 55. The bolt 40 has to slidably move within the receiver 45 to allow another projectile 35 to enter the receiver 45 and be pushed into the barrel 55. A closed bolt pneumatic gun 5 is illustrated, but one skilled in the art will appreciate that the present invention is easily adaptable to open bolt systems as well as closed bolt systems of varying designs.

An embodiment of the present invention, as shown in FIG. 1, includes a means to detect cycle progress 60, a means to forcibly return the trigger to the released position 65, and a means to control cycle speed 70. Demonstrated is a pneumatic system. The means to detect cycle progress 60 is supplied a constant pneumatic pressure via a first hose 75. The means to detect cycle progress 60 is in fluid communication with the means to forcibly return the trigger to the released position 65 via a second hose 85. The second hose 85 is normally not pressurized.

Figure 2:
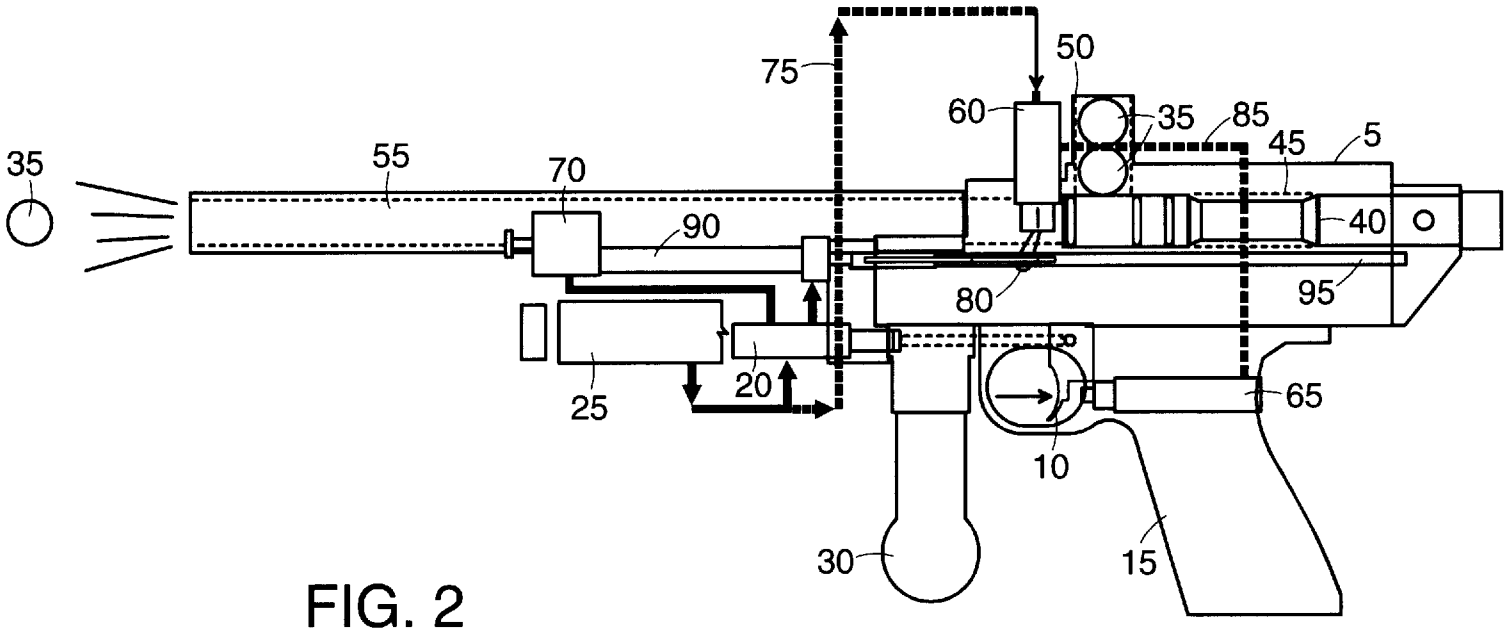
FIG. 2 is a side view, including the internal workings, of a pneumatic gun at the firing stage equipped with an embodiment of the invention.

In brief overview, FIG. 2 represents an embodiment of the pneumatic gun 5 as the projectile 35 is fired, being forcibly ejected from the pneumatic gun 5 via the barrel 55. At this point, the system of the present invention has not been activated.

Figure 3:
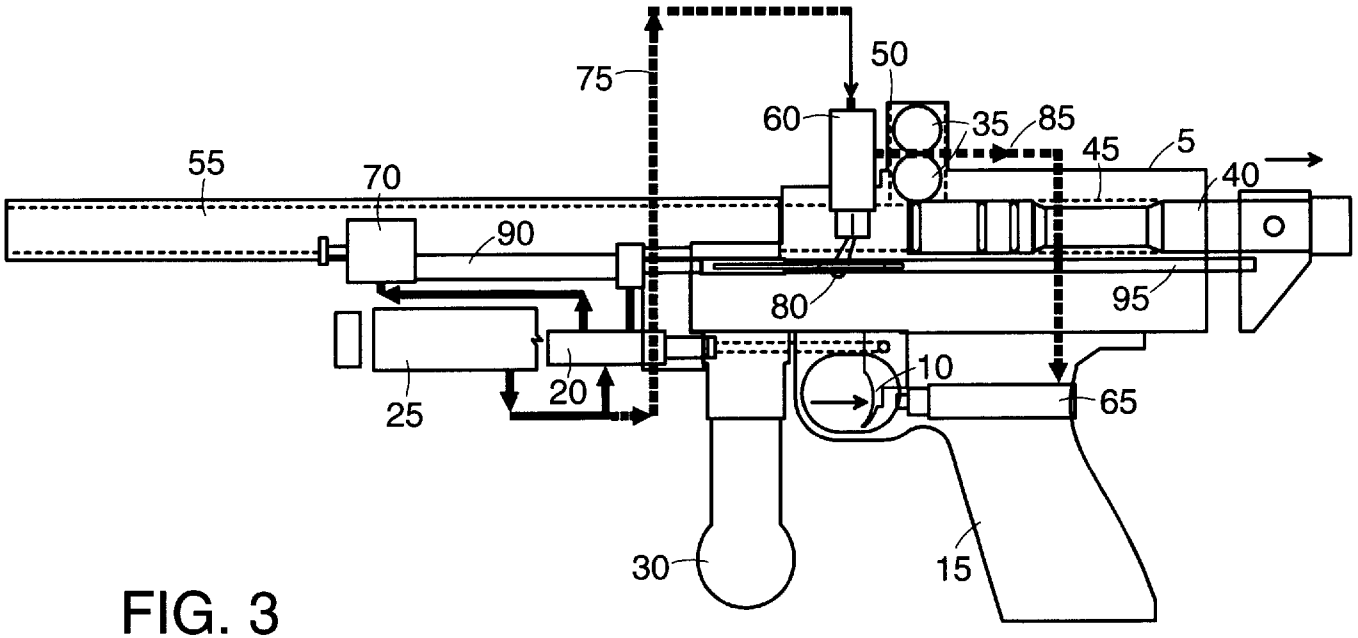
FIG. 3 is a side view, including the internal workings, of a pneumatic gun at the start of the recoil stage equipped with an embodiment of the invention.

In brief overview, FIG. 3 represents an embodiment of the pneumatic gun 5 as the bolt 40 starts to slide back within the receiver 45. In the illustrated style of pneumatic gun 5, the bolt 40 is slid back by a bolt piston 90 in communication with the bolt 40 via a connecting rod 95. Other styles of pneumatic guns slide the bolt 40 back in various ways, but the present invention can be adapted to all styles of pneumatic, and non-pneumatic, guns. In the preferred embodiment, the means to detect cycle progress 60 is a toggle switch 3-way poppet valve. Pressure flows through the toggle switch 3-way poppet valve only when a toggle switch 80 is in a certain position. The means to detect cycle progress 60 is in communication with the bolt 40 via the connecting rod 95 by the toggle switch 80. At the point shown in FIG. 3, the system of the present invention has not been activated.

Figure 4:
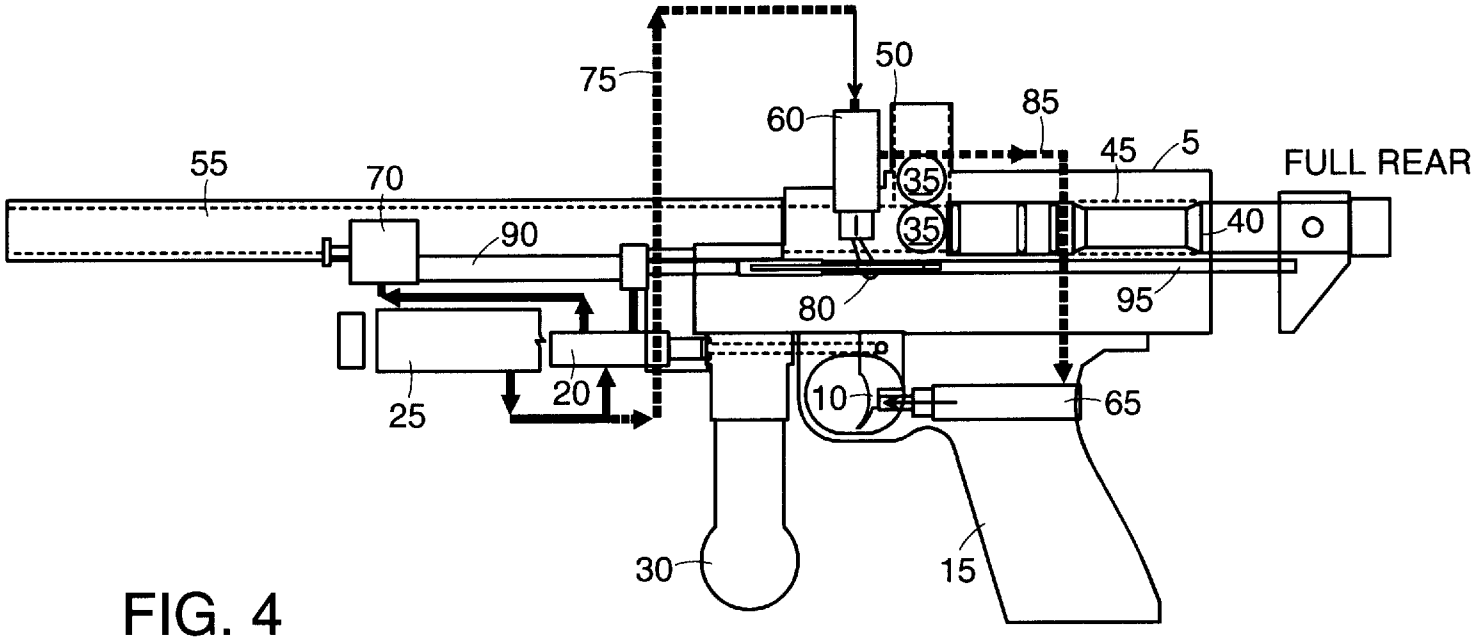
FIG. 4 is a side view, including the internal workings, of a pneumatic gun at the fully recoiled stage equipped with an embodiment of the invention.

In brief overview, FIG. 4 represents an embodiment of the pneumatic gun 5 with the bolt 40 at the point of its furthest rearward travel. The toggle switch 80 has been moved to a position which allows pressure to flow into the second hose 85. The pressure that flows in the second hose 80 activates the means to forcibly return the trigger to the released position 65. In the preferred embodiment, the means to forcibly return the trigger to the released position 65 is a single acting spring-return piston. The pressure via the second hose 85 pushes the piston forward against the trigger 10 and forces the trigger 10 to release.

Figure 5:
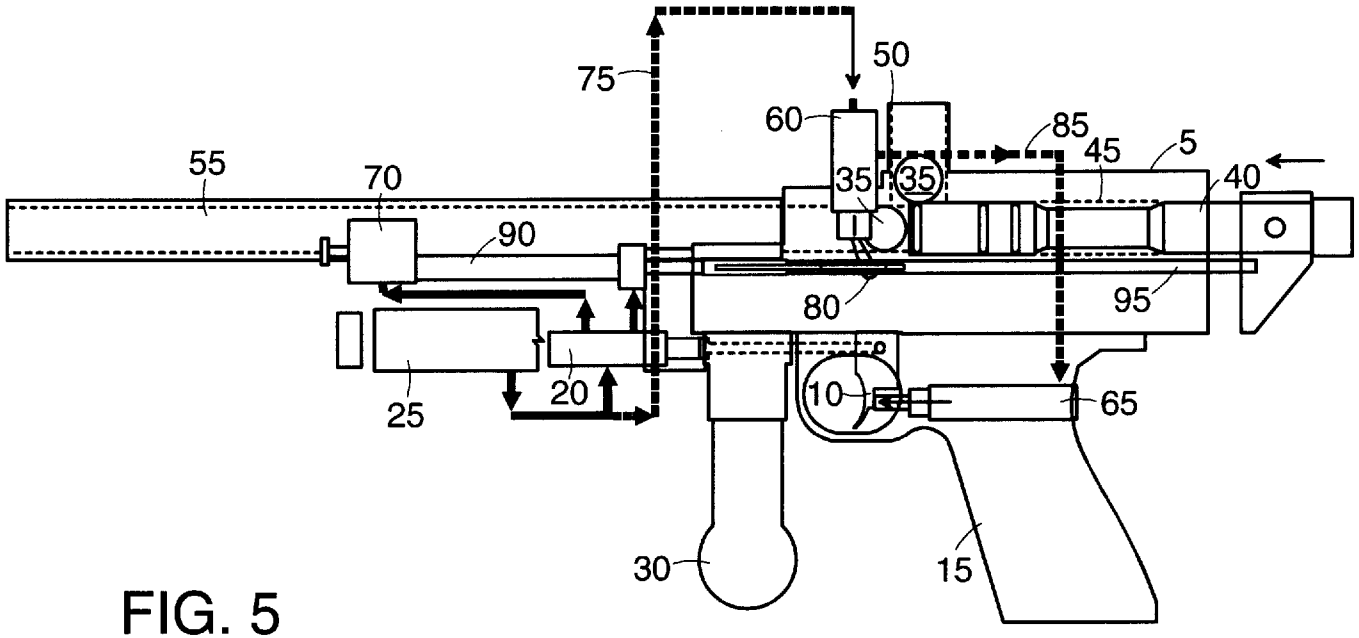
FIG. 5 is a side view, including the internal workings, of a pneumatic gun returning to the ready stage equipped with an embodiment of the invention.

In brief overview, FIG. 5 represents an embodiment of the pneumatic gun 5 as the bolt 40 is returning to the closed position. The bolt 40 pushes another paintball 35 along the receiver 45 and into the barrel 55. The toggle switch 80 is still in a position that allows the second hose 85 to remain pressurized, thereby keeping the means to forcibly return the trigger to the released position 65 activated. The bolt 40 will reach a point whereby the connecting rod 95 will flip the toggle switch 80 and pressure will no longer flow into the second hose 85 and thereby release pressure on the means to forcibly return the trigger to the released position 65. When the pressure is released from the means to forcibly return the trigger to the released position 65, the trigger 10 can be pulled to fire the pneumatic gun 5 again.

The present invention results in a fire rate with which present paintball delivery systems cannot accommodate.

The bolt 40 has to be slowed on it returns travel or there is a risk of breaking the paintball 35 entering the receiver 45. This is accomplished via a means to control cycle speed 70. The preferred embodiment utilizes an adjustable flow controller. The flow controller restricts the exhaust flow of bolt piston 90 thereby impeding the return slide of the bolt 40. The adjustable flow controller allows for adjustments to the exhaust from completely open to completely closed. Completely open would allow the exhaust to flow unimpeded. Completely closed would allow no exhaust to flow thereby causing the bolt 40 to remain in the full rearward position until the exhaust was allowed to escape. The nature of these adjustable flow controllers allows for almost infinite incrementation to the bolt 40 return speed. The adjustable flow controller also allows for adjustments to fire rate on the field.

One skilled in the art will appreciate that other components can be used to accomplish the present invention. The preferred embodiment uses a toggle switch 3-way poppet valve as the means to detect cycle progress 60. The means to detect cycle progress 60 could be an electrical, magnetic or infra red switch. The means to detect cycle progress 60 could also be pneumatic valves other than mechanically switched. Electrically switched or magnetically switched pneumatic valves could also be used. The purpose would all be the same: to detect cycle progress and relay the information to the means to forcibly return the trigger to the released position 65.

The preferred embodiment used a single acting spring-return piston as the means to forcibly return the trigger to the released position 65. Solenoid valves could be used as well as double acting pneumatic pistons. The preferred embodiment used a single acting spring-return piston sized to deliver 14 pounds force to the trigger 10. Pistons of varying sizes could be used to accommodate users who preferred a heavier trigger 10 or a lighter trigger 10. The preferred embodiment employs the means to forcibly return the trigger to the released position 65 in direct contact with the trigger 10. One skilled in the art will appreciate that the means to forcibly return the trigger to the released position 65 could communicate with the trigger 10 via linkage to forcibly release the trigger 10.

The preferred embodiment places the means to control cycle speed 70 at the side of the bolt piston 90 that is exhausting when the bolt 40 is sliding forward. Other embodiments could have the adjustable flow controller at either end of the bolt piston 90. The position of the adjustable flow controller allows for easy adjustments at either end of the bolt piston 90. In the present invention, the bolt piston 90 was replaced with a longer stroke piston to increase the time the bolt 40 is in the open position. This is not necessary for the present invention to be practiced, but it is another method to control cycle speed by increasing the time the bolt 40 is in the open position.

It is envisioned that there can be numerous devises and combinations of devises used for the means to detect cycle progress 60, the means to forcibly return the trigger to the released position 65, and the means to control cycle speed 70. Various embodiments can be appreciated by one skilled in the art. It can also be appreciated that the present invention is adaptable to not only semi-automatic pneumatic guns, but also semi-automatic firearms. The workings of a semi-automatic firearm will not require a means to control cycle speed 70 because the bolt will only cycle as fast as an ammunition clip feeding ammunition will allow.

What is claimed is:

1. A Trigger Assist System for a semi-automatic gun, the semi-automatic gun having a receiver, a bolt that slidably moves within the receiver, an opening in communication with the receiver for loading of a projectile, a barrel in communication with the receiver for discharging the projectile and a trigger in communication with the bolt, the trigger movable from a released position to a firing position, the firing position activating a cycle whereby the projectile is forcibly ejected from the barrel and the bolt slides within the receiver to allow another projectile to enter the receiver, the released position allowing the trigger to be ready to cycle again, the Trigger Assist System comprising:

A means to detect cycle progress in communication with the semi-automatic gun; and A means to forcibly return the trigger to the released position in communication with the means to detect cycle progress and in communication with the trigger whereby the means to detect cycle progress communicates with the means to forcibly return the trigger to the released position when to activate and the means to forcibly return the trigger to the released position moves the trigger to the released position at a point in the firing cycle after the projectile has been ejected and the bolt is sliding within the receiver and the means to detect cycle progress subsequently communicates with the means to forcibly return the trigger to the released position to deactivate at a point after the firing cycle is complete allowing the trigger to be pulled again.

2. The Trigger Assist System of claim 1 further comprising

A means to control cycle speed in communication with the semi-automatic gun whereby the means to control cycle speed allows the trigger assist system to be activated at a variable rate.

3. The Trigger Assist System of claim 1 wherein

The means to detect cycle progress is a switchable pneumatic valve in communication with the bolt.

4. The Trigger Assist System of claim 1 wherein

The means to detect cycle progress is a 3-way poppet valve in communication with the bolt.

5. The Trigger Assist System of claim 1 wherein

The means to detect cycle progress is a 3-way cartridge valve in communication with the bolt.

6. The Trigger Assist System of claim 1 wherein

The means to detect cycle progress is a switchable electronic sensor in communication with the bolt.

7. The Trigger Assist System of claim 1 wherein

The means to detect cycle progress is a timing circuit in communication with the trigger whereby the timing circuit calculates the time between the trigger being pulled and the time to activate the means to forcibly return the trigger to the released position and subsequently calculates the time to deactivate the means to forcibly return the trigger to the released position.

8. The Trigger Assist System of claim 1 wherein

The means to forcibly return the trigger to the released position is a pneumatic piston.

9. The Trigger Assist System of claim 1 wherein

The means to forcibly return the trigger to the released position is an electronic solenoid.

10. The Trigger Assist System of claim 1 wherein

The means to forcibly return the trigger to the released position is a single acting spring-return piston.

11. The Trigger Assist System of claim 2 wherein

The means to control cycle speed is an adjustable flow controller in communication with a bolt piston, the bolt piston being in communication with the bolt.

12. The Trigger Assist System of claim 2 wherein

The means to control cycle speed is an adjustable electronic delay circuit in communication with the means to forcibly return the trigger to the released position whereby the electronic delay circuit variably controls the time the means to forcibly return the trigger to the released position applies force to the trigger.

13. A Trigger Assist System for a semi-automatic gun, the semi-automatic gun having a receiver, a bolt that slidably moves within the receiver, an opening in communication with the receiver for loading of a projectile, a barrel in communication with the receiver for discharging the projectile, a source of compressed gas for discharging the projectile and moving the bolt, and a trigger in communication with the bolt, the trigger movable from a released position to a firing position, the firing position activating a cycle whereby the projectile is forcibly ejected from the barrel and the bolt slides within the receiver to allow another projectile to enter the receiver, the released position allowing the trigger to be ready to cycle again, the Trigger Assist System comprising:

A switchable pneumatic valve in communication with the bolt; and

A pneumatic piston in communication with the switchable pneumatic valve and in communication with the trigger whereby the switchable pneumatic valve communicates with the pneumatic piston when to activate and the pneumatic piston moves the trigger to the released position at a point in the firing cycle after the projectile has been ejected and the bolt is sliding within the receiver and the switchable pneumatic valve subsequently communicates with pneumatic piston to deactivate at a point after the firing cycle is complete allowing the trigger to be pulled again.

14. The Trigger Assist System of claim 13 further comprising

An adjustable flow control valve in communication with a bolt piston to adjust the bolt return speed.

* * * * *